US005476190A

United States Patent [19]

Herrmann et al.

[11] Patent Number: 5,476,190

[45] Date of Patent: Dec. 19, 1995

[54] DISPENSING/VENDING MACHINE AND METHOD WITH LOCKABLE, PORTABLE DISPENSING CHUTES

[75] Inventors: Herbert L. Herrmann; Jeffrey A. Belka; Michael C. Brown, all of San Diego, Calif.

[73] Assignee: Lottery Enterprises Inc., San Diego, Calif.

[21] Appl. No.: 310,932

[22] Filed: Sep. 22, 1994

Related U.S. Application Data

[63] Continuation of Ser. No. 132,383, Oct. 6, 1993, abandoned.

[51] Int. Cl.[6] ..... B65H 1/00

[52] U.S. Cl. ..... 221/197; 221/274

[58] Field of Search ..... 221/197, 287, 221/312 B, 105, 114, 95, 92, 268, 258, 273, 274, 131, 13, 154, 151, 152, 108, 103, 129; 220/345; 312/293.1, 293.3

[56] References Cited

U.S. PATENT DOCUMENTS

| | | | |
|---|---|---|---|
| 1,135,658 | 4/1915 | Brown et al. | 221/154 |
| 1,741,474 | 12/1929 | Moore | 221/154 |
| 2,532,083 | 11/1950 | Brenner | 220/345 |
| 3,168,965 | 2/1965 | Rinn | 221/197 |
| 3,180,697 | 4/1965 | Mulch | 220/345 |
| 3,410,452 | 11/1968 | Igel et al. | 221/13 |
| 4,051,978 | 10/1977 | Kiefer | 221/197 |
| 4,526,264 | 7/1985 | MacNamara | 194/1 N |
| 4,851,651 | 7/1989 | Gaucher | 235/380 |

FOREIGN PATENT DOCUMENTS

| | | | |
|---|---|---|---|
| 36964 | 8/1977 | Australia . | |
| 707405 | 4/1954 | United Kingdom | 221/197 |

*Primary Examiner*—Kenneth Noland

*Attorney, Agent, or Firm*—Curtis, Morris & Safford; Gregor N. Neff

[57] ABSTRACT

A vending machine for dispensing relatively flat, thin articles, and particularly for dispensing valuable articles such as debit cards and tickets. The articles to be dispensed are stored in removable chutes. Lockable covers are provided for the chutes so as to provide safe transportation containers for the valuable articles. Automatic device is provided for displacing the covers upon insertion of the chutes into the dispensing mechanism so as to prepare the mechanism for immediately dispensing the articles and eliminating the need to totally remove the covers during usage.

21 Claims, 5 Drawing Sheets

DISPENSING/VENDING MACHINE AND METHOD WITH LOCKABLE, PORTABLE DISPENSING CHUTES

This application is a continuation of application Ser. No. 08/132,383, filed Oct. 6, 1993 now abandoned.

This invention relates to dispensing and vending devices, and particularly to such devices for dispensing and/or vending relatively thin, flat valuable articles such as lottery tickets and debit cards.

Machines for vending separate lottery tickets such as "pull-tab" tickets are being sold by Lottery Enterprises, Inc. of San Diego, Calif. Those machines use removable "drop-in" chutes to hold the tickets. Each chute can be simply lifted out and replaced by inserting a new chute in to the receptacle vacated by the old chute. Thus, the games to be played and supplies of tickets can be changed quickly and easily. Moreover, the chutes can be pre-loaded with tickets at a distant location for greater loading speed, convenience and safety.

The same machine now is proposed for use in issuing "debit cards"—that is, cards which have recorded on them certain amounts of monetary credit corresponding to a payment made. Such cards can be used in telephones, transportation turnstile machines, and other devices designed to accept them. The telephone or turnstile machine subtracts a certain amount from the credit on the card corresponding to the use made of the telephone, etc. When the credit on the card is used up, the holder must buy a new card.

Debit cards, lottery tickets and other tickets have a certain intrinsic value, and thus are desirable objects to steal. Applicants have recognized that this is a particularly serious problem in the case of debit cards, in that a single chute full of debit cards can be worth thousands of dollars, and every card can have a substantial value. Moreover, the cards are particularly vulnerable to theft when being transported to the vending machines.

Accordingly, it is an object of the invention to provide an article holder for dispensing and vending devices which gives protection against theft or loss of valuable articles, particularly during transportation of the holder.

It is a specific object to provide secure portable containers for such articles as debit cards, lottery and other tickets, etc., which containers do double duty as article holders during dispensing operations.

It is a further object to provide a dispensing and vending machine which is adapted to use such containers to good advantage.

Another object is to provide such a dispensing container and vending machine which are sturdy, simple and reliable in operation, and relatively inexpensive to make.

The foregoing objects are met by the provision of lockable chutes which can be inserted into dispensing receptacles in vending/dispensing machines. When unlocked, the chutes allow the dispensing of the articles. When locked, they protect the articles from theft or loss, thus permitting loading and locking the chutes in a secure location, carrying them to the vending machines, unlocking them and using them to hold the articles, within the secure housing of the machine, until dispensed.

In a preferred embodiment of the invention, the cover, when unlocked, is automatically moved to open a dispensing outlet in the chute when the chute is inserted into the machine.

Advantageously, the cover covers both the outlet opening and the open inlet end of the chute at the same time.

Other features and advantages of the invention are set forth in or apparent from the following description, drawings and claims. In the drawings:

Figure 1:
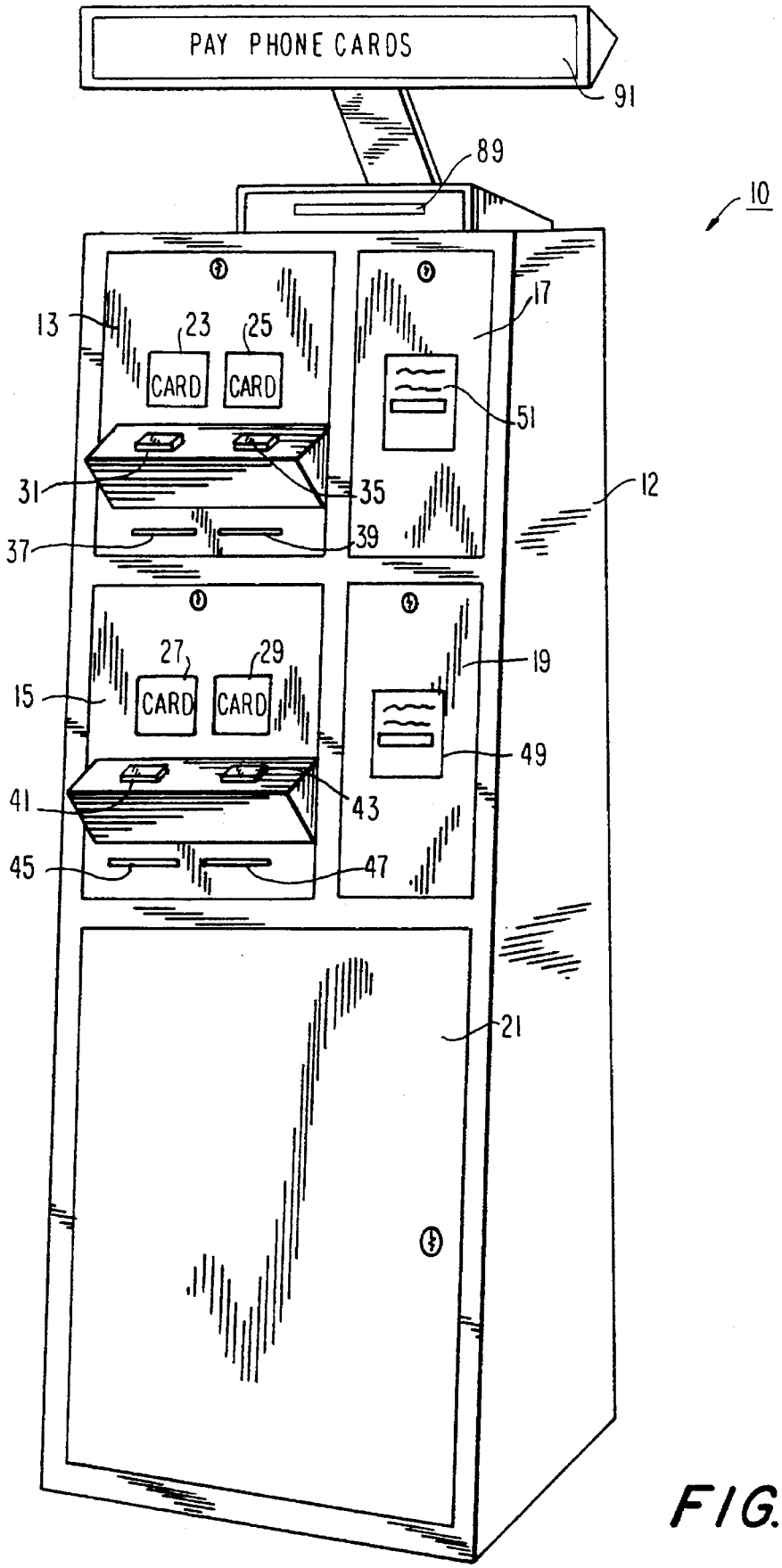
FIG. 1 is a perspective view of a vending machine using the present invention.

FIG. 1 is a perspective view of a debit card vending machine 10 constructed in accordance with the present invention. The vending machine 10 includes a housing 12 and hinged lockable front panels 13, 15, 17, 19 and 21.

Figure 7:
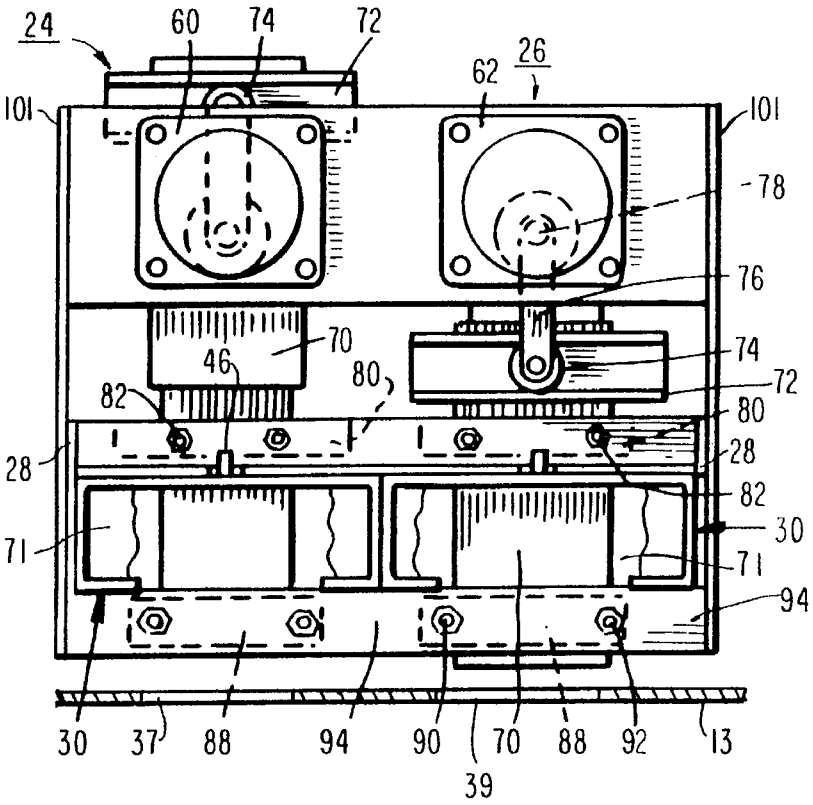
FIG. 7 is a top plan view of the mechanism shown in FIG. 5.
Figure 6:
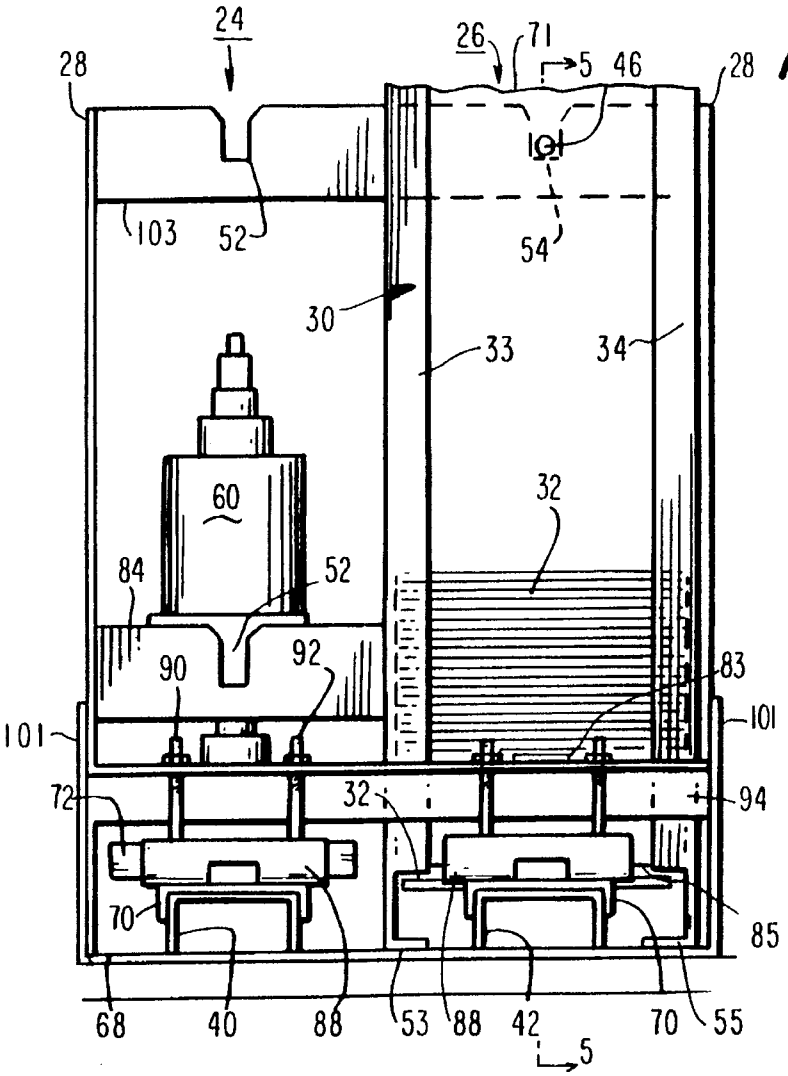
FIG. 6 is a front elevation view of the mechanism shown in FIG. 5.

Mounted inside the housing 12 behind each of the panels 13 and 15 is a pair of dispensing mechanisms (not shown in FIG. 1) for dispensing debit cards. Two such mechanisms 24 and 26 are shown in FIGS. 6 and 7 and will be described in detail below.

Associated with each of the dispensing mechanisms is a window 23, 25, 27, or 29 which displays a sample of the card to be dispensed by the corresponding dispensing mechanism. Also associated with each dispensing mechanism is a push-button 31, 35, 41 or 43 which the customer can push to dispense one or more debit cards. The cards are dispensed through an outlet slot 37, 39, 45 or 47, each of the slots being associated with a specific one of-the four dispensing mechanisms.

A monetary exchange acceptor 49 is mounted in the panel 19. The acceptor 49 preferably accepts currency, but also can accept other forms of monetary exchange, such as coins, credit cards, etc.

The panel 17 has a window 51 with operating instructions displayed behind the window.

A LED display unit 89 at the top of the machine 10 displays the amount of credit the customer has, and other information.

A separate electronic visual display 91 is supported above the top of the machine 10 to display an advertising message. In this particular case, the message displayed is "PAY PHONE CARDS", which indicates to the customer that the debit cards to be dispensed by the machine are of the type usable with pay phones.

Each of the panels 13, 15, 17, and 19 is hinged at the bottom so that it can be pivoted outwardly in order to give access to the mechanisms and/or electronics behind the panels.

The panel 21 is hinged at the side and is provided basically for storage.

Figure 2:
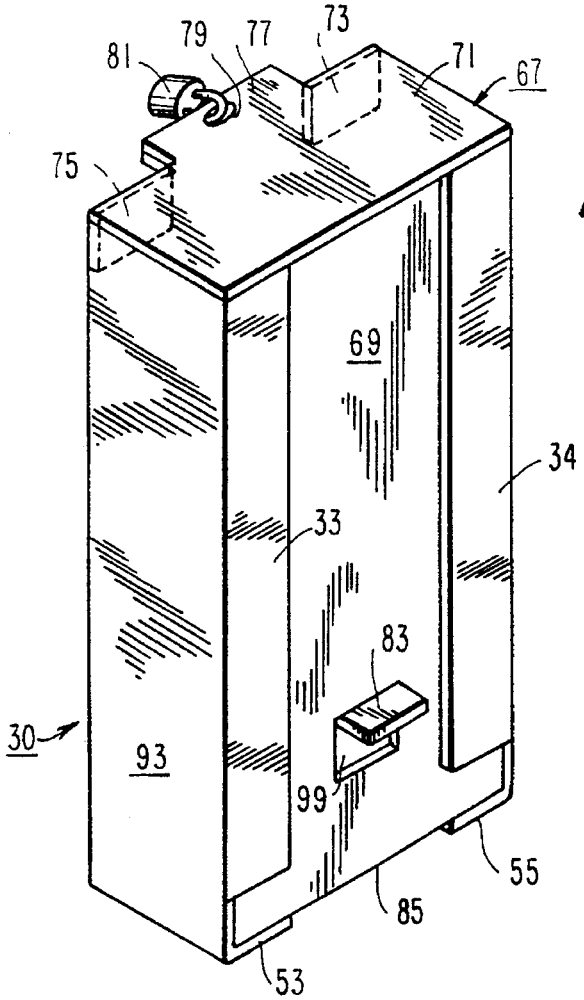
FIG. 2 is a perspective view of a lockable article chute used in the machine of FIG. 1.

FIG. 2 is a perspective view showing a locked chute 40 constructed in accordance with the present invention. The chute shown in FIG. 2 consists of a chute body shown in FIG. 3, together with a lockable cover 67 shown in FIG. 2.

Figure 3:
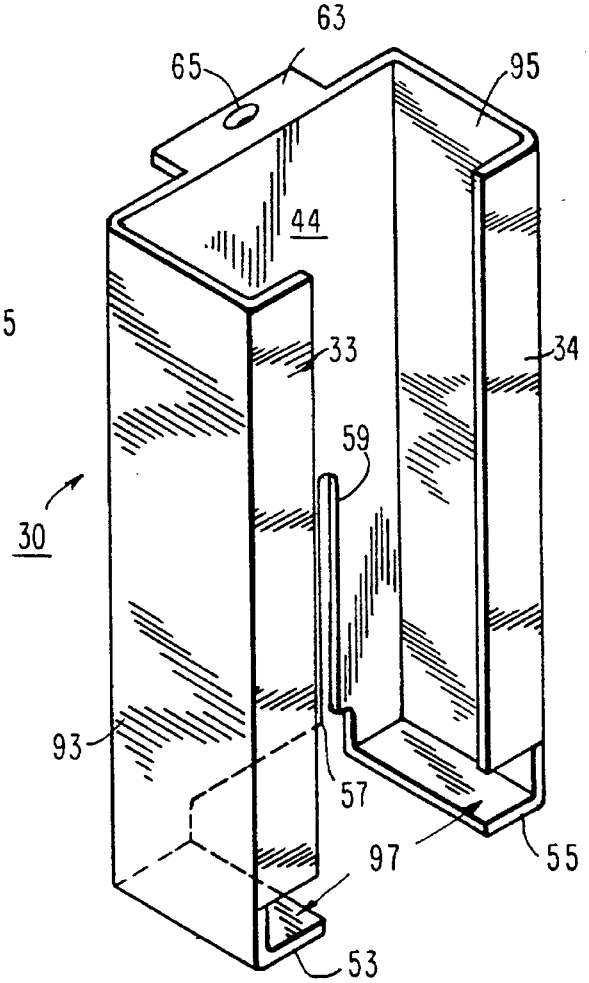
FIG. 3 is a perspective view of the chute of FIG. 2 without the cover.

Referring now to FIG. 3, the chute body consists of a generally C-shaped metal member, preferably made of heavy gage aluminum, with front flanges 33 and 34, side panels 93 and 95, and a rear panel 44. The front flanges 33 and 34 are cut away at their bottom ends, and the bottom edges of the side panels 93 and 95 are bent to form flanges 53 and 55 so as to leave open spaces 97 between the bottom edges of the flanges 33 and 34 and the flanges 53 and 55, respectively. The spaces 97 form a dispensing outlet opening for the chute. The flanges 53 and 55 hold the articles in the chute so they will not fall out of the bottom of the chute when it is lifted.

The rear panel 44 is cut away in the area 57 at the bottom end in order to accommodate a portion of the dispensing mechanism, to be described below.

A vertical slot 59 is cut in the rear panel 44 to allow the chute to be inserted vertically downwardly into a receptacle in the dispensing mechanism over a the arm 109 (FIG. 5) of a feeler switch which extends into the chute. The feeler switch detects the absence of debit cards at a certain level in the chute and actuates an indicator to indicate when the card supply has reached a low level.

At the upper edge of the rear panel 44 of the chute body a tab 63 extends outwardly perpendicular to the panel 44. The tab 63 has a locking hole 65.

Referring again to FIG. 2, the cover structure includes a vertical panel 69 which fits inside the chute and slides against the inside surfaces of the flanges 33 and 34. The panel 69 is bent to form a top cover panel 71 which is perpendicular to the vertical panel 69. Bent-over tabs 73 and 75 extend downwardly into the chute and bear against the rear panel 44 of the chute body to provide a secure fit.

The top panel 71 has a tab 77 which extends outwardly and is of the same size and shape as the tab 63 on the chute body. The tab 77 has a hole 79 which is the same size and shape and aligns with the hole 65 in the tab 63. The hasp of a padlock 81 then can be inserted through the holes 65 and 79 and locked in order to lock the chute and protect its contents.

If preferred, a wire can be inserted through the holes 65 and 79 and the ends sealed together so that the chute is sealed shut. Such a sealed chute is deemed to be a "locked" chute, as that that term is used in this patent application.

The vertical panel 69 of the cover 67 has a tab 83 which is punched out of the material of the panel 69, leaving a hole 99.

Figure 4:
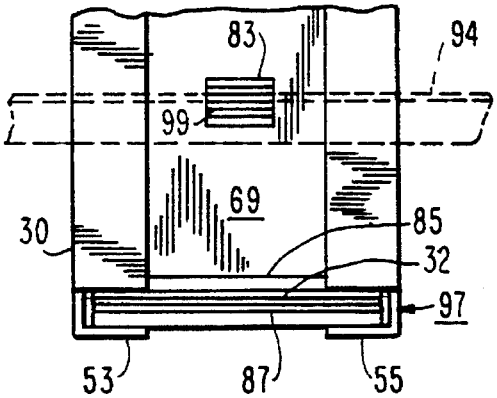
FIG. 4 is a front elevation view, partially broken away, of the lockable chute shown in FIG. 2 with the cover unlocked and lifted up to allow dispensing of articles from the dispensing outlet.

FIG. 4 is a front elevation view, partially broken away, of the lockable chute shown in FIG. 2, but with the cover lifted to allow debit cards 32 to be dispensed from the chute.

When the chute is loaded with debit cards, it usually is loaded through the open top of the chute with the cover removed. The debit cards 32 form a stack of cards which almost fills the chute. At the bottom of the stack is inserted a metal plate 87, of about the same size and shape as the articles to be dispensed, which is part of the cover structure and is provided to protect the articles from being removed through the bottom area of the chute between the flanges 53 and 55. This plate preferably made of a material such as 1/16 to 1/8 inch thick galvanized or stainless steel, or a comparably strong aluminum plate.

As it will be explained in greater detail below, when the chute full of debit cards is loaded into the vending machine, the lock or seal is removed from the chute so that the panel 69 is free to slide upwardly and downwardly in the chute body. Then, when the chute is inserted into the receptacle in the machine, a cross-bar 94 in the dispenser mechanism makes contact with the tab 83, and this lifts the panel 69 and the cover 67 upwardly so that the bottom edge 85 of the panel 69 no longer blocks the outward opening 97 from the chute.

The bottom edge 85 of the front panel 69 of the cover 67 abuts against the flanges 53 and 55 when the cover is in place and locked.

The stack of debit cards and the plate 87 will be lifted up slightly by contact with another part of the dispensing mechanism, as it is shown in FIG. 6 of the drawings. The plate 87 then can be removed by hand, or it can be dispensed by the dispensing mechanism to allow the debit cards to be dispensed thereafter.

Thus, it can be seen that the cover 57 can be removed entirely, or may be automatically displaced upwardly to uncover the outlet opening of the chute, as desired. It is highly advantageous to be able to leave the cover in place so that the cover and the chute body can be kept together. Thus, there is no storage problem for storing the covers 67 separately from the chute bodies, and the covers do not readily become separated and lost.

As it is shown in FIGS. 5 through 8, each of the chutes 30 as a pair of vertically spaced studs 46 extending outwardly from the rear panel 44. These studs fit into slots 52 and 54 (see FIGS. 5, 6 and 8) to guide the chutes into proper alignment with the dispensing mechanism, and hold them in place. This structure forms part of a receptacle into which the chutes can be simply dropped to load the vending machine. The chutes can be removed by simply lifting them out in order to quickly and easily change or replenish the supply of articles to be dispensed.

FIGS. 5 through 8 show two dispensing mechanisms 24 and 26 which are located behind one of the front panels 13 or 15 on the vending machine 10. The dispensing mechanisms are identical, and only one of the them, mechanism 26, will be described in detail here.

The dispensing mechanism includes a bottom support panel 68 with vertical side panels 101. Secured to the bottom panel 68 is a channel member 42 of generally C-shaped cross-section with the channel opening facing downwardly.

A pusher member 70 is provided to push one of the articles to be dispensed from the bottom of the stack and out of the machine through one of the slots 39 (see FIG. 5) in the front of the vending machine shown in FIG. 1.

The pusher member 70 also has a channel shape and is dimensioned to fit slidably onto the channel member 42 so as to slide along and be guided by the channel member 42 during the dispensing movement.

Secured to the pusher member 70 is another channel member 72. Member 72 extends in a direction perpendicular to the channel member 70.

Figure 5:
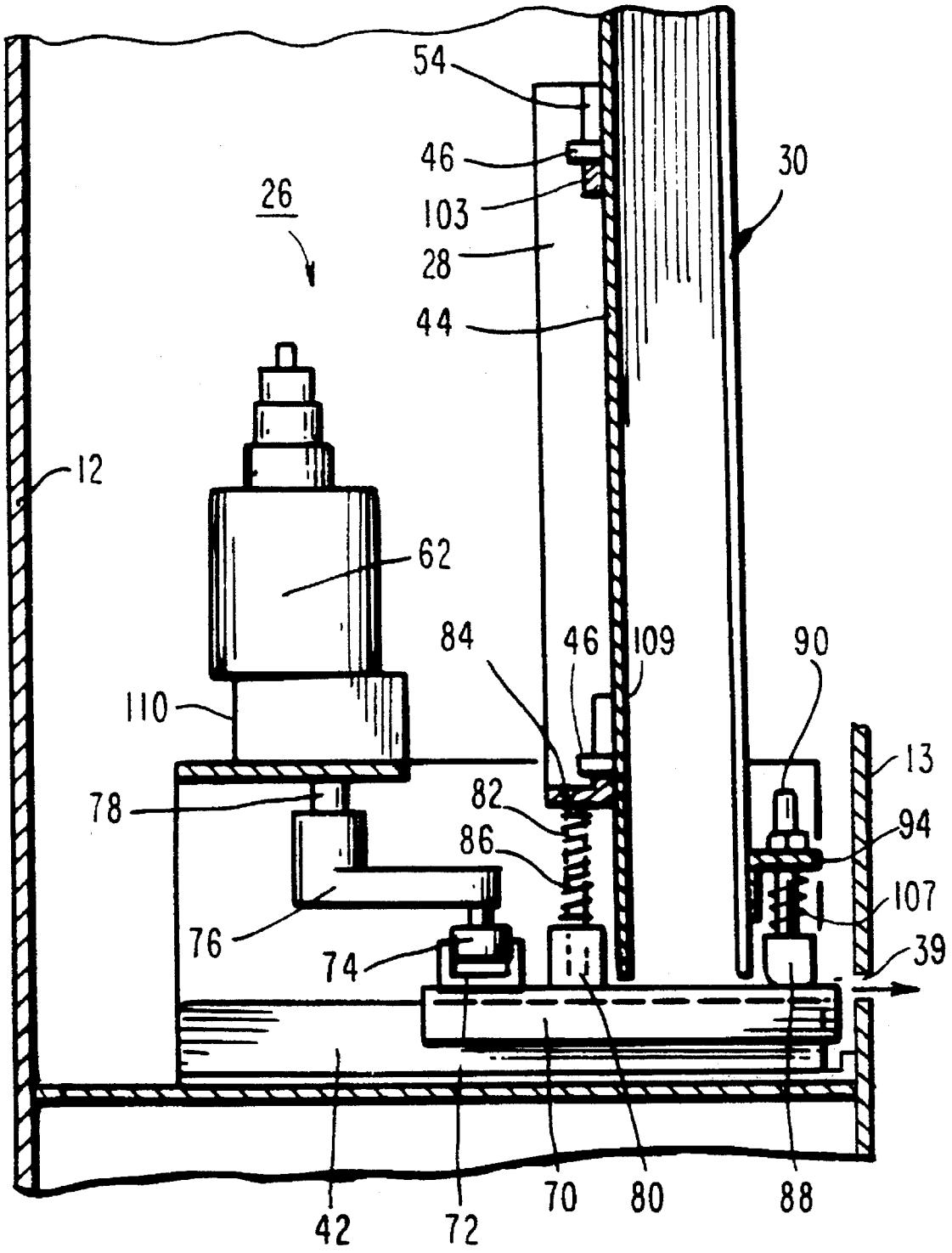
FIG. 5 is a side elevation view, partially cross-sectional of one of the dispensing mechanisms used in the vending machine shown in FIG. 1 with the cross-section being taken along line 5—5 of FIG. 5.
Figure 8:
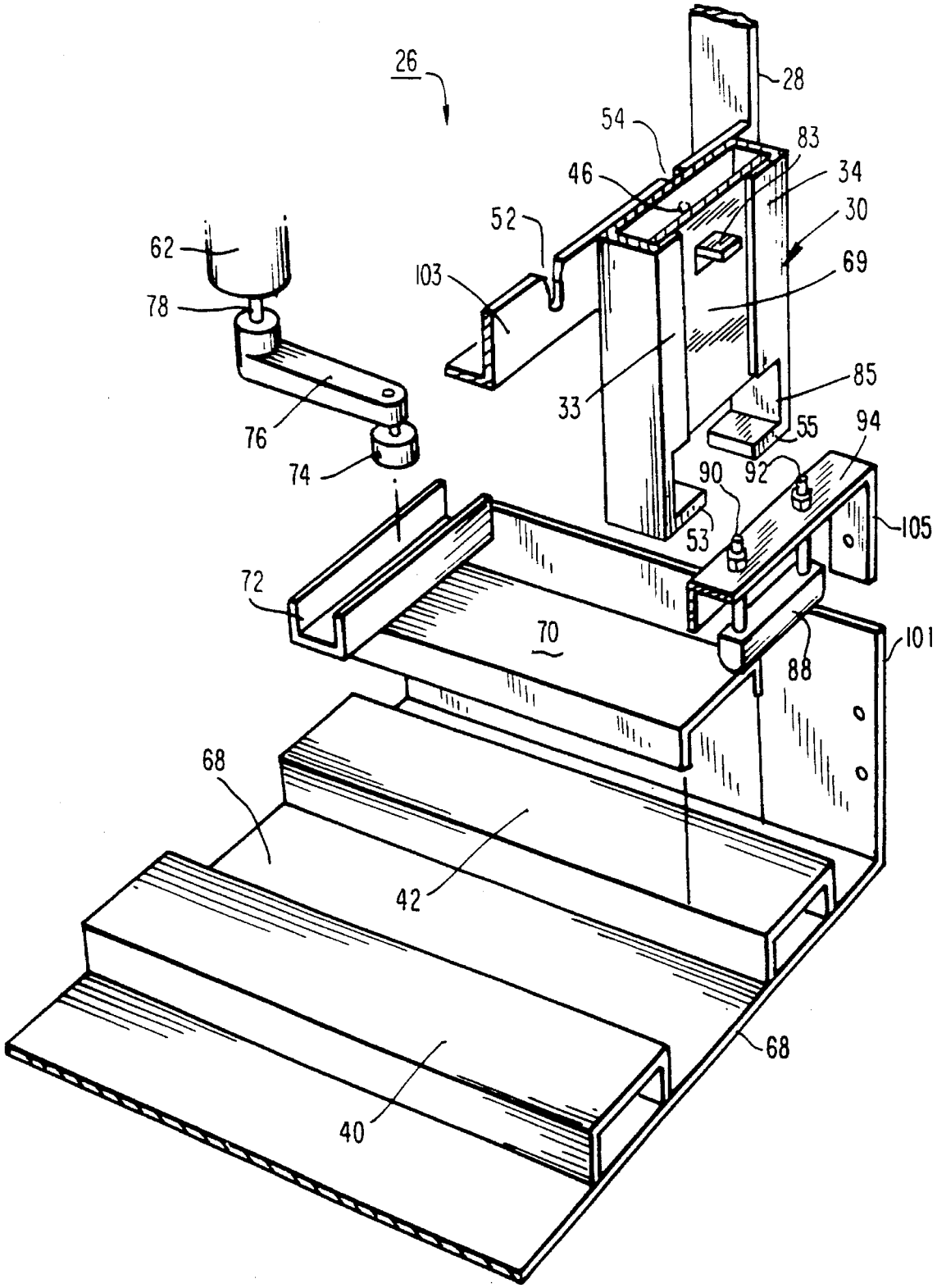
FIG. 8 is an exploded perspective view of the mechanism shown in FIG. 5.

Referring particularly to FIGS. 5 and 8, an electrical drive motor 62 is provided to rotate a drive shaft 78 through a speed reducer 110. A crank arm 76 is attached to the shaft 78. A roller 74 dimensioned to fit into the channel of the member 72 is rotatably attached to the end of the crank arm 76.

When the motor is started, it rotates the shaft and crank arm 76 and this causes the channel member 72 and the pusher 70 to be moved in a reciprocating motion first forwardly to dispense an article 32, and then backwardly to a rest position. At the forward end of its travel, the pusher pushes one of the articles to be dispensed through the outlet opening 39. The motor stops when the pusher 70 reaches its rest position, and waits for instructions to dispense another article. A suitable microprocessor-based control system (not shown) is provided to control the operation of the dispensing mechanisms.

As it is shown in FIGS. 5 and 6, the slots 52 and 54 into which the studs 46 of the chutes are inserted are formed in cross-bars 84 and 103 extending between vertical support members 28.

As it is shown in FIGS. 5 and 7, the dispensing mechanism 26 has a pressure block 80 which is urged downwardly by springs 86 mounted on pins 82 which are fastened at one end to the cross-bar 84, as it is shown in FIG. 7. The pressure block 80 is slideable on the pins 82. The springs 86 thus apply pressure to the pusher 70 to hold it in contact with the support 42 while it is moving forwardly and backwardly. Preferably, the block 80 is made of nylon or Delron plastic material.

As it is shown in FIGS. 5 through 8, and particularly in FIGS. 5 and 8, another cross-bar 94 is provided at the front of the dispensing mechanism. It is attached between the vertical side panels 101 by means of flanges 105 at the ends.

The cross-bar 94 has several different functions. First, it defines the front edge of the receptacle into which the chute is inserted. The bars 84 and 103 define the rear edges of the receptacle, and the slots 54 and 52 define the location of the chutes vertically and in a direction perpendicular to the direction of motion of the articles being dispensed.

A further function of the cross-bar 94 is as a support for a so-called "gapping" block 88 which is slidably mounted on a pair of pins 90 and 92 secured to the cross-bar 94. The block 88 is urged downwardly by a pair of springs 107.

The gapping block 88 preferably has a rounded lower left corner edge, as seen in FIG. 5, and is made of a wear-resistant plastic material such as nylon or Delron. The gapping block applies downward pressure against any articles being dispensed from the chute 30 so as to deter the unwanted dispensing of more than one article at a time.

As it is shown in FIG. 4 and explained above, a third function of the cross-bar 94 is to automatically lift the cover of the chute to open the dispensing outlet of the chute when it is inserted into the receptacle.

It should be understood that the dimensions of the chutes shown in FIGS. 5 through 8 are somewhat different from the dimensions of the chute shown in FIGS. 2 through 4. In particular, the chute shown in FIGS. 5 through 8 it is not as wide in the front to rear dimensions as the chute shown in FIGS. 2 through 4. This is because the chute in FIGS. 2 through 4 is for debit cards, and the mechanism shown in FIGS. 5 through 8 is and particularly the "pull-tab" type of lottery tickets. Such tickets tend to be narrower than debit cards. Additionally, the depths of the channels 42 and 70 would be somewhat less for use with the chutes shown in FIGS. 2 through 4. These variations in dimensions are typical of those experienced when the nature and size of the articles being dispensed changes.

As it can be seen from the foregoing, the above-described invention well satisfies the objectives set forth above. The chute with a lockable cover admirably protects the valuable contents from theft. Thus, the chutes can be loaded with the valuable articles at a safe location, locked and/or sealed, and sent out with service representatives to be loaded into the vending machines at the vending locations. Since the chutes are locked, they tend to deter would-be thieves from stealing from them. If the chutes are sealed, surreptitous theivery can be discouraged because a broken seal indicates possible pilferage and often identifies the thief.

The above description of the invention is intended to be illustrative and not limiting. Various changes or modifications of the embodiments described may occur to those skilled in the art and these can be made without departing from the spirit or scope of the invention.

We claim:

1. A secure dispensing machine chute for holding relatively flat, thin articles of intrinsic value for dispensing, said chute comprising an elongated storage container for storing an array of said articles, said container having a dispensing outlet opening adjacent one end, a mounting structure for mounting said chute in a receptacle in a dispensing machine housing and a removable cover for covering said outlet opening, said cover and said container having mating lock surfaces capable of being locked together to lock said cover in place, said outlet opening being shaped to permit the entry of a relatively flat, thin pusher plate to push one of said articles form the bottom of said array to dispense it when said chute is mounted in said housing.

2. A chute as in claim 1 which has a loading inlet opening adjacent the end of said chute opposite said one end, said cover extending over said inlet opening to cover it as well as said outlet opening.

3. A chute as in claim 1, said cover including a panel slidable mounted in said chute to slide into first position in which it covers said opening, and a second position in which it does not cover said opening, said cover and said chute each having a lock opening, said lock openings being positioned to be aligned with one another when said cover is in said first position, whereby a locking member can be inserted through said openings to lock said cover and said chute together, said chute having a vertical slot to accomodate a feeler switch arm.

4. A chute as in claim 2, said cover being L-shaped with a sliding panel and an inlet cover portion, with holes in said inlet cover portion and a portion of said chute adjacent said inlet opening for receiving a locking member.

5. A chute as in claim 1, said cover having a surface positioned to engage a stop member adjacent said receptacle when said chute is inserted into said receptacle and thereby move said cover away from said outlet opening when said cover is unlocked.

6. A chute as in claim 1, said chute having an access opening for admitting a dispensing member into said container to dispense said articles through said outlet opening, and a cover plate for covering said access opening when said cover is locked.

7. A dispensing device for dispensing relatively flat, thin articles of intrinsic value from at least one array, said device comprising, in combination, a housing, a dispensing mechanism, at least one receptacle in said housing for receiving and holding a removable chute for containing a supply of said articles and positioning said receptacle adjacent said dispensing mechanism to facilitate the dispensing of said articles from said chute by said mechanism, said chute having a dispensing outlet opening, and a lockable cover for covering said opening.

8. A device as in claim 7 including a plurality of said receptacles for receiving a plurality of said chutes, and a separate dispensing mechanism for each of said receptacles.

9. A device as in claim 7, in which said cover is movably mounted on said chute to move into and out of covering relationship to said outlet opening, said receptacle including an engagement member for engaging said cover and moving it out of covering relationship to said outlet opening in response to the insertion of said chute into said receptacle.

10. A device as in claim 7 in which said outlet opening is located adjacent one end of said chute, and including a loading inlet opening adjacent the opposite end of said chute, said cover being adapted to cover both said inlet and said outlet opening, and a vertical slot in said chute for receiving a feeler switch arm.

11. A device as in claim 7 in which said outlet opening is adjacent one end of said chute, said cover including a panel slidable mounted in said chute to slide into a first position in which it covers said opening, and a second position in which it does not cover said opening, said cover and said chute each having a lock opening, said lock openings being positioned to be aligned with one another when said cover is in said first position, whereby a locking member can be inserted through said openings to lock said cover and said chute together.

12. A device as in claim 11 in which said chute has an inlet opening at the end of said chute opposite said one end, and said cover has a flange extending from one end to cover said inlet opening when said cover is in said first position.

13. A device as in claim 12 including a lock tab extending from one edge of said flange and a lock flange extending from an edge of said chute in abutting relationship to said lock tab, said lock openings being located in said lock tab and said lock flange.

14. A device as in claim 7 in which said cover includes a panel slidable in said chute into and out of covering relationship to said outlet opening, said mechanism including an engagement member for engaging said panel and moving it out of covering relationship to said outlet opening in response to the insertion of said chute into said receptacle, said panel having a projection extending outwardly into a position to contact said engagement member to move said panel out of covering relationship upon insertion of said chute into said receptacle.

15. A device as in claim 7 in which said outlet opening is adjacent one end of said chute, said one end having an access opening for admitting a portion of said dispensing mechanism into said chute, and a second cover member for covering said access opening.

16. A device as in claim 15 in which said chute has two side walls, a front wall and a rear wall, the lower ends of said side walls extending beyond the ends of said front and back walls and being bent inwardly to form spaced-apart flanges to hold said articles in said chute in the absence of said second cover, said outlet opening comprising the space between said flanges, said second cover comprising a plate of the same shape as one of said articles and of the thickness to pass through said outlet opening upon start-up of said dispensing mechanism.

17. A vending machine for vending relatively flat, thin articles of intrinsic value, said vending machine having a housing, a monetary exchange acceptor for accepting monetary exchange items and crediting the depositor of said items with appropriate amounts of payments, a dispensing mechanism, a removable chute for securely holding said articles while out of said housing, a receptacle for receiving and securing said chute in said housing in response to the insertion of said chute into said receptacle said chute having a dispensing opening adjacent said dispensing mechanism when said chute is in said receptacle, said monetary exchange acceptor being adapted to control said dispensing mechanism to dispense a number of said articles corresponding to the credit given to said depositor, said chute having a lockable cover for covering said outlet opening while said chute is outside of said housing, in which said articles are selected from the group consisting of tickets and debit cards and said chute has an open top end with said outlet opening at the bottom end, said cover being generally L-shaped with a vertical panel slidably contained in said chute, and an end cover portion extending outwardly from said panel to cover said open top end, said end cover portion and one wall of said chute adjacent said top end having holes which align with one another when said cover is in locking position.

18. A method of replenishing the supply of flat, thin items of intrinsic value to be dispensed from dispensing machines at spaced geographic locations, said method comprising the steps of:

(a) providing a plurality of chutes, each having an opening, and a cover lockable to cover said opening and movable to uncover said opening when unlocked, (b) loading said items into said chutes with said covers unlocked at a first station remote from at least some of said geographic locations, (c) locking said covers of said chutes and transporting said chutes to said remote geographic locations, and (d) at each of said locations, unlocking said covers and uncovering said openings in some of said chutes and installing the latter chutes in the dispensing machines at said location.

19. A method as in claim 18 in which said dispensing machines have receptacles for receiving said chutes and holding said chutes in response to the insertion of the chutes therein, said installing step comprising dropping said chutes into said receptacles.

20. A method as in claim 18 in which said dispensing machines are vending machines for vending articles in response to the deposit of units of monetary exchange by a purchaser, each of said chutes having an inlet opening in addition to the first-named opening, said cover covering said inlet opening when locked and being removable to open said inlet for loading.

21. A method as in claim 19 in which said articles are selected from the group consisting of debit cards and tickets.

* * * * *